US006258772B1

(12) United States Patent
Yeggy et al.

(10) Patent No.: US 6,258,772 B1
(45) Date of Patent: Jul. 10, 2001

(54) CLEANING COMPOSITIONS COMPRISING PERFLUORINATED ALKYLPHOSPHATES

(75) Inventors: Robert C. Yeggy; Vito J. Alta Villa, both of Cincinnati, OH (US)

(73) Assignee: Bay Technologies, Inc., Cincinnati, OH (US)

( * ) Notice: Subject to any disclaimer, the term of this patent is extended or adjusted under 35 U.S.C. 154(b) by 0 days.

(21) Appl. No.: 09/686,602

(22) Filed: Oct. 11, 2000

Related U.S. Application Data

(60) Provisional application No. 60/158,821, filed on Oct. 12, 1999.

(51) Int. Cl.[7] ..... C11D 1/34; C11D 1/83
(52) U.S. Cl. ..... 510/422; 510/467
(58) Field of Search ..... 510/422, 467

(56) References Cited

U.S. PATENT DOCUMENTS

| | | | | |
|---|---|---|---|---|
| 3,585,145 | * | 6/1971 | Fethke | 252/99 |
| 3,738,943 | | 6/1973 | Kaneko | 252/540 |
| 5,004,825 | * | 4/1991 | Yoshida et al. | 558/131 |
| 5,338,475 | | 8/1994 | Corey et al. | 252/102 |
| 5,415,811 | | 5/1995 | Wile et al. | 252/546 |
| 5,460,753 | | 10/1995 | Holdar | 252/544 |
| 5,650,097 | | 7/1997 | Wysong et al. | 252/392 |
| 5,712,240 | | 1/1998 | Tyerech et al. | 510/424 |
| 5,861,365 | | 1/1999 | Colurciello, Jr. et al. | 510/278 |

FOREIGN PATENT DOCUMENTS

| | | | |
|---|---|---|---|
| 526976 A1 | * | 2/1993 | (EP) . |
| 1342220 | * | 1/1974 | (GB) . |
| WO 98/14540 | * | 4/1998 | (WO) . |

* cited by examiner

*Primary Examiner*—John Hardee
(74) *Attorney, Agent, or Firm*—Frost Brown Todd LLC

(57) ABSTRACT

A cleaning composition, having a neutral pH, and capable of removing soils, particularly greasy and oily soils without re-deposition, from both hard surfaces and fabrics is disclosed. The composition comprises a mixture of specifically-defined alcohol ethoxylate nonionic surfactants, specifically-defined fluorophosphate surfactants, and detergency builders, particularly phosphate builders, such as SAPP and TKPP. The compositions provide outstanding removal of soils, particularly greasy and oilly soils, under ambient conditions. The method of cleaning hard surfaces and fabrics using these compositions is also disclosed. Finally, an apparatus for utilizing these cleaning compositions in an ultrasonic cleaning process, for example, for metal parts, is also disclosed.

27 Claims, No Drawings

CLEANING COMPOSITIONS COMPRISING PERFLUORINATED ALKYLPHOSPHATES

This application is based on and claims priority from U.S. Provisional Patent Application Ser. No. 60/158,821, Robert C. Yeggy and Vito J. Alta Villa, filed Oct. 12, 1999.

TECHNICAL FIELD

The present invention relates to cleaning compositions for removal of soils from both hard surfaces and fabrics.

BACKGROUND OF THE INVENTION

The removal of soils from both hard surfaces (e.g., industrial maintenance, post-construction cement and brick, household flooring, kitchen and bathroom surfaces) and fabrics is an age-old problem which has been addressed in a variety of ways. Typically, different types of compositions are used for hard surface cleaning and fabric cleaning and the approaches used frequently fall into one of two types.

The first type of composition includes surfactants with relatively heavy ion loadings, such as trisodium phosphate and, more recently, tetrapotassium pyrophosphate and/or the metasilicate salts of sodium or potassium. These compositions are frequently sold as powders for water dilution or as pre-solvated solutions. They have relatively high pH (typically around 10 or even greater) and, as such, are caustic with related physiological risks. Further, the phosphate and silicate present in the compositions potentially pose a significant environmental risk.

The second general category of cleaners utilizes mixtures of solvents, detergent emulsifiers and pH shifting compounds such that the compositions either have a relatively low pH (2 or less, incorporating, for example, organic and inorganic acids) or a relatively high pH (9 or more, incorporating various amines, hydroxide salts and/or ammonia). These pH adjustments are utilized because it is difficult to solvate greasy and oily soils using typical pH neutral compositions and, accordingly, cleaning efficiency is typically enhanced at the higher or lower pHs. Such acid or alkaline compositions can also present problems in terms of color change, bleaching and/or leaching of the surfaces cleaned, potential damage to rubber or plastic substrates contacted, damage to fabrics cleaned, and potential damage to users, pets or children from contact with the eyes, skin or possible ingestion. These compositions also tend to leave deposits of acidic or alkaline salts on surfaces when dried. These residues can reactivate with moisture to produce caustic and degrading secondary surface conditions. Finally, the solvents utilized in these compositions can pose both safety and environmental issues.

It, therefore, would be highly desirable to be able to formulate a cleaning composition which removes a wide variety of soils, including heavy greasy and oily soils, from both hard surfaces and fabrics with great efficiency, and which can be formulated at neutral pH and without the use of high levels of solvents. The present invention addresses this need through the use of combinations of specifically-defined nonionic alcohol ethoxylate surfactants and fluorophosphate surfactants.

Nonionic alcohol ethoxylate surfactants and fluorosurfactants have been disclosed for use in cleaning compositions of various types. However, the specific surfactants defined herein have not heretofore been used together in a hard surface or fabric cleaning composition.

U.S. Pat. No. 5,338,475, Corey, et al., issued Aug. 16, 1994, discloses an aqueous carpet cleaning composition comprising fluorophosphates, one or more surfactants selected from nonionic, anionic and amphoteric surfactants, and hydrogen peroxide in an aqueous solution having a pH between 4.0 and 6.4.

U.S. Pat. No. 5,861,365, Colurciello, et al., issued Jan. 19, 1999, discloses an aqueous cleaning and surface treatment composition which is said to be particularly suitable for cleaning and treating carpets and carpet fibers. U.S. Pat. No. 5,712,240, Tyerech, et al., issued Jan. 27, 1998, describes an aqueous carpet cleaning composition which is said to impart water and oil repellency characteristics to carpet surfaces and to carpet fibers treated with the composition. Both Colurciello and Tyerech disclose the use of fluorophosphates as optional surfactants which may be added to the disclosed cleaning compositions. These patents also disclose the use of alcohol ethoxylates as optional nonionic surfactants which may also be added to the cleaning compositions. Neither of these patents describes or suggests the use of fluorophosphates together with alcohol ethoxylates.

U.S. Pat. No. 5,415,811, Wile, et al., issued May 16, 1995, discloses an aqueous cleaning composition which is said to be useful for cleaning hard surfaces, such as glass. The composition comprises an aqueous mixture of an alcohol, a glycol ether and a fluorosurfactant. The fluorosurfactant disclosed specifically is a potassium fluoroalkylcarboxylate. The preferred glycol ether disclosed is ethylene glycol monobutyl ether.

SUMMARY OF THE INVENTION

The present invention encompasses a cleaning composition in the form of a homogeneous aqueous solution having a pH of from about 6 to about 7.5, which comprises:

(a) from about 45% to about 85% of a $C_9$–$C_{15}$ alcohol ethoxylate containing from about 4 to about 10 ethoxy groups, or a mixture of such ethoxylates;

(b) from about 0.5% to about 10% of fluorosurfactants selected from the group consisting of:

(I)

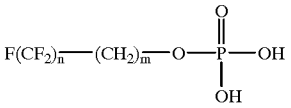

(II)

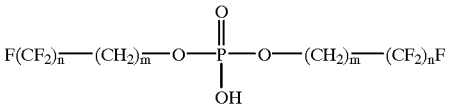

including their salts, and mixtures thereof, wherein each n is from about 6 to about 16 and each m is from about 1 to about 6; and (c) from about 5% to about 50% of a detergent builder;

The present invention also encompasses methods for cleaning fabrics or hard surfaces (such as metal surfaces and plastics) comprising agitation of the fabrics or hard surfaces in the presence of an aqueous solution of the above-described cleaning composition. When the composition is used to clean hard surfaces, such as metal parts, it is particularly useful to contact those surfaces with an aqueous solution of the detergent composition in the presence of ultrasonic energy.

Ways of using the cleaning composition of the present invention include use in an ultrasonic cleaning device or in a spray-washing device, wherein a pressurized aqueous solution contacts the surface being cleaned. The spray-washer can operate at either high or low pressures, with temperatures ranging from about 50° F. to about 200° F. Most spray washers are multi-staged devices that generally include multiple wash and rinse sections.

The ultrasonic device comprises a vessel capable of holding the items to be cleaned and a detergent solution; means for imparting ultrasonic energy into the interior of said vessel; and a control means which prevents the imparting of ultrasonic energy to the vessel after the passage of a predetermined amount of time or number of starts. This allows the items to be cleaned during a period of time in which the detergent solution is relatively clean and does not contain an amount of grease or oil or particulates from previous cleaning operations which would overly burden the cleaning operation. After the predetermined period of time has passed, the machine automatically shuts down, at which time it is serviced to filter or replace the detergent solution to remove the extraneous dirt and to reset the control means on the ultrasonic cleaning device to permit it to be used until the next time servicing is required.

Without intending to be limited by theory, one possible mechanism as to how the cleaning composition of the present invention works is that it not only offers superior cleaning capability, but also offers the characteristics of a superior rinse-agent as well. In general, many types of cleaning equipment are designed to mechanically remove and separate cleaning agents from the rinse section of washers since traditional cleaning agents typically leave a residue on the object being cleaned. Particularly for soft metals, additional residue is generated on the object being cleaned through oxidation of the metal and through saponification of surface oils. The cleaning composition of the present invention prevents the re-deposition of particulate and soil, as well as cleaning agent, on the surface of the object being cleaned. This unique performance characteristic is attributable to the lack of surface tension and overall "wetting" of the cleaned surface inherent in the composition of the present invention. The addition of a cleaning agent to the rinse section of washers represents a fundamental paradigm shift in cleaning methodology, which heretofore has been avoided or discouraged. Thus, the cleaning composition of the present invention not only provides for optimal soil removal from the object being cleaned, but also for surface cleanliness and overall maintenance of the entire cleaning process.

As used herein, all percentages and ratios stated are "by weight", unless otherwise specified.

DETAILED DESCRIPTION OF THE INVENTION

The present invention relates to cleaning compositions which provide outstanding soil removal, especially greasy and oily soil removal, from both hard surfaces and fabrics. These compositions are generally in the form of a homogeneous solution and have a neutral pH generally from about 6 to about 7.5, preferably from about 6.7 to about 7.3. These compositions comprise three essential components:

(1) a specifically-defined alcohol ethoxylate nonionic surfactant;

(2) a specifically-defined fluorophosphate surfactant; and (3) a detergent builder.

Nonionic Surfactants

The nonionic surfactant which is used in the present invention is an ethylene oxide condensate of an aliphatic alcohol, i.e., an alkanol, containing from about 9 to about 15 carbon atoms, or mixtures of such surfactants. The aliphatic alcohol is preferably linear. These surfactants are prepared by conventional oxyalkylene condensation reactions well known in the art. Generally, they are prepared by reacting an alkylene oxide with the linear aliphatic alcohol in the presence of a suitable oxyalkylation catalyst, such as sodium hydroxide, potassium hydroxide, or the like, at a temperature of about 125° C. and at a pressure of from about 34 to about 90 psig. The alcohols utilized contain from about 9 to about 15 carbon atoms, and preferably from about 10 to about 11 carbon atoms. The alcohol ethoxylates typically contain from about 4 to about 10, preferably from about 5 to about 9, and most preferably from about 5 to about 7 ethoxy groups. The alcohol ethoxylate surfactants generally have the formula:

$$(C_xH_{2x+1})O(CH_2\ CH_2O)_yH \qquad \text{(III)}$$

wherein x is from about 9 to about 15, preferably from about 10 to about 11; and y is from about 4 to about 10, preferably from about 5 to about 9, and most preferably from about 5 to about 7. The alcohols utilized in making the surfactants and may be naturally derived, such as from coconut oil, or they may be synthetically derived, such as from linear alkenes. Small amounts of branched-chain alcohols may be used in connection with the linear alcohols so long as there is no interference with the biodegradability of the resulting product. An example of the type of alcohol ethoxylate herein contemplated is sold under the trade name NEODOL. Preferred NEODOL materials are NEODOL 1–5 and NEODOL 1–7, which contain predominantly $C_{10}$ and $C_{11}$ alcohols with an average of 5 and 7 ethylene oxide groups per molecule, respectively.

The compositions of the present invention typically contain from about 45% to about 85%, preferably from about 60% to about 70% of the alcohol ethoxylate component.

Fluorophosphate Surfactants

The fluorophosphate surfactants utilized in the present invention are those having the formulas:

(I)

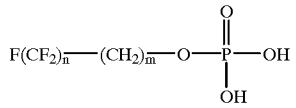

(II)

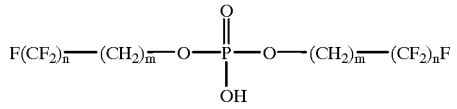

including their salts, and mixtures of those surfactants. In these formulas each n is independently selected and has a value from about 6 to about 16, preferably from about 10 to about 14; and each m is independently selected and has a value from about 1 to about 6, preferably about 2. A preferred surfactant for use in the present invention is a mixture of the two fluorosurfactants defined above wherein the ratio of compound (I) to compound (II) is from about 60:40 to about 50:50. The surfactants shown above are shown in their protonated form, however, they may also be used in their deprotonated form in the present invention, for example the ammonium or diethanolamine salts of compound (I).

The fluorosurfactants which may be utilized in the present invention are commercially available under the trade name ZONYL. One particular fluorosurfactant is ZONYL 9027 which contains about 18% of the compound (I), wherein n is from 6 to 16 and m is 2, and about 16% of the compound (II), where n is 6 to 16 and m is 2, those compounds present in a solution (i.e., about 66% of the total composition) comprising proponol and water. The solution also contains small amounts of diethanolamine. The compositions in the present invention contain from about 0.5% to about 10%, preferably from about 1% to about 5% of the fluorophosphate surfactant component. If 7.5% of the ZONYL 9027 material (which contains about 34% active material) is used in the composition of the present invention, the composition contains about 2.5% of the fluorophosphate material.

The relative levels of the alcohol ethoxylate nonionic surfactant and the fluorophosphate surfactant are selected and balanced relative to each other such that the final detergent composition product is a homogeneous solution. If the appropriate relative amounts are not utilized, the composition has a lumpy, "cottage cheese" texture. This type of composition would not be uniform and would not be aesthetically acceptable to the consumer. Therefore, the ratio of the nonionic and the fluorophosphate surfactants is selected such that the final product is a homogeneous solution. Obviously, this ratio will depend on the identity of the particular nonionic surfactant utilized, as well as on the identity of the fluorophosphate. A preponderance of the nonionic surfactant, when compared to the fluorophosphate surfactant, is generally utilized, and it is preferred that the ratio of the nonionic surfactant to the fluorophosphate surfactant be in the range of from about 45:1 to about 15:1, most preferably from about 40:1 to about 30:1.

Detergent Builders

The final required component of the cleaning compositions of the present invention is a conventional detergency builder component. This builder is present at from about 5% to about 50%, preferably from about 8% to about 30% of the final composition. The detergent builders are preferably sequestering agents, which promote the solubility of the surfactants in water. These builders are well known and widely reported in available patents and literature. Typical compounds are alkali metal compounds such as alkali metal silicates, alkali metal carbonates, alkali metal phosphates, and the like. Representative of the alkali metal compounds which are sequestrants are sodium tripolyphosphate, tetrapotassium pyrophosphate, tetrasodium pyrophosphate, trisodium phosphate, sodium hexametaphosphate and the like. Phosphate builders are preferred for use in the present invention. These preferred builders include, for example, sodium acid pyrophosphate (SAPP), tripotassium pyrophosphate (TKPP), and mixtures thereof Particularly preferred detergent compositions include about 8% to about 16% SAPP and about 8% to about 16% TKPP.

Corrosion Inhibitors

Corrosion inhibitors may optionally be added to the detergent composition. Corrosion inhibitors, also known as anti-corrosive or anti-rust agents, reduce the degradation of the metallic parts contacted by the detergent and are incorporated at a level of about 0.5% to about 15%, and preferably about 1% to about 10% by weight of the total composition. The use of such corrosion inhibitors is preferred when the detergent is in contact with a metal surface. Suitable corrosion inhibitors include alkyl and aryl carboxylic acids and carboxylate salts thereof; sulfonates; alkyl and aryl esters; primary, secondary, tertiary and aryl amines; phosphoric esters; epoxides; mercaptans; and diols. Also suitable are the $C_{12}$–$C_{20}$ fatty acids, or their salts, especially aluminium tristearate; the $C_{12}$–$C_{20}$ hydroxy fatty acids, or their salts; and neutralized tall oil fatty acids. Phosphonated octa-decane and other anti-oxidants such as betahydroxytoluene (BHT) may also be used.

Other useful corrosion inhibitors include organic zinc complexes such as a zinc citrate, zinc hydroxy oxime complexes, and zinc copolymer complexes of acrylic acid ethacrylate; nitrogen and sulfur-containing aryl heterocycles; alkanolamines such as triethanolamine; amine-neutralized alkyl acid phosphates; dibasic acids neutralized with amines, where the dibasic acids include, but are not limited to, adipic acid, succinic acid, sebacic acid, glutaric acid, malonic acid, suberic acid and examples of amines include, but are not limited to, methylamine, ethylamine, ethanolamine, diethanolamine, triethanolamine and N,N-dimethylcyclohexylamine, and mixtures thereof. Additional corrosion inhibitors which may be used are disclosed in U.S. Pat. No. 5,650,097, Wysong et al., issued Jul. 22, 1997, which is herein incorporated by reference. Each of the above-mentioned anti-corrosives can be used individually or in combination thereof, or in combination with other types of additives.

Compositions of the present invention may also contain as the anti-corrosive agent from about 1% to about 5%, by weight of an anti-corrosive agent which is mixture comprising a surfactant other than an alkyl acid phosphate; at least one alkyl acid phosphate, in a surfactant-phosphate weight ratio in the range between 10:1 and 1:10, said phosphate having the general formula:

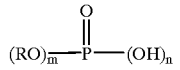

wherein R is an alkyl group having 4 to 20 carbon atoms; m is 1 or 2; and n is 3-m. The alkyl phosphate may be amine-neutralized with a tertiary amine such as N,N-dimethylcyclohexylamine, and also contain from about 5% to about 40%, by weight, based on the combined weight of said surfactant and said phosphate, of at least one carboxylic acid which has both a hydrophilic and hydrophobic portion, such as dodecylsuccinic acid. Mixtures of such chemical components are sold under the trade name ZELEC DI.

A mixture of anti-corrosive agents which may be used in the present invention includes from about 70% to about 80%, by weight, of a nitrogen and sulfur-containing aryl heterocycle, such as 10-H-phenothiazine, and from about 20% to about 30%, by weight, of an alkanolamine, such as triethanolamine.

Defoaming Agents

Defoaming agents are also optional components, and are preferably included in any cleaning context where extensive foaming occurs, such as in the laundering of fabrics. The defoaming component is generally used at levels of from about 0.5% to about 7%, preferably about 5% of the total composition. Defoamers are not typically used in the context of ultrasonic cleaning. Silicon antifoaming agents, such as SAG 30, are conveniently used in fabric laundering compositions. Silicon defoamers cannot be used for the washing of metal parts in the auto industry since they interfere with the application of paint on those parts. In those instances, a nonsilicon defoaming agent, such as DEPRESS 14, could be used. Other nonsilicon defoaming agents include acetylenic diols, such as FOAM BLAST 43-080-01, or an aliphatic polyoxyethylene ether, which is described as a polymeric defoamer made from a fatty alcohol ethoxylate with epichlorohydrin and formed in a polymeric star configuration. This material is commercially available, under the trade name DEHYDRAN.

Additional Detergent Composition Components

The cleaning compositions of the present invention may also contain conventional detergent composition additives, at their conventional usage levels, to achieve their known benefits. Thus, the composition may include a solvent which generally comprises lower ($C_{1-C4}$) alcohols (preferably propanol), water, or mixtures of alcohols and water. This solvent system is described above in the context of describing the ZONYL fluorophosphate surfactant component. The compositions may also include a buffer component, such as diethanolamine or triethanolamine, to help maintain the pH of the composition within the desired neutral pH range (e.g., at from about 0.25% to about 1.0% of the composition).

Other conventional components which may be optionally included in the present invention include agents to control the rheology of the composition, such as thickeners or dilutants (e.g., Carbopol); perfumes; colorants; whitening agents or brighteners; preservatives, to prevent microbial growth in the compositions themselves; antimicrobials or biocides, to disinfect the surfaces being cleaned.

Applications

The present invention also encompasses the methods of cleaning both fabrics and hard surfaces, including metals and plastics, utilizing the cleaning compositions of the present invention. Thus, in the method of cleaning fabrics, the fabrics to be cleaned are placed in an aqueous solution comprising from about 0.25% to about 10%, preferably from about 0.25% to about 5%, of the cleaning composition defined above and are subjected to agitation. The compositions are also particularly useful for cleaning metal and plastic surfaces. In this method, the surfaces to be cleaned are contacted with an aqueous solution comprising from about 0.02% to about 10%, preferably from about 0.02% to about 5%, of the cleaning composition described above. In both cases (fabrics and hard surfaces), it is preferred that the surface being cleaned be rinsed, after cleaning, to remove excess cleaning composition and residual soils.

In the cleansing of metal surfaces, such as metal parts, it is particularly effective if the parts are subjected to an aqueous solution of the cleaning composition and the solution is then applied through spray nozzles or in an ultrasonic washer (introducing ultrasonic energy). A particularly useful cleaning device for use with such ultrasonic energy comprises a vessel capable of holding the items to be cleaned together with a detergent solution, such as the one described above; a means for imparting ultrasonic energy into the interior of said vessel, and thereby into the cleaning solution which contains the parts to be cleaned; and a control means which prevents the starting of the ultrasonic energy generating device if certain conditions are met. Examples of such conditions include the passage of a predetermined amount of time or number of starts, or the presence of a threshold level of soil in the cleaning solution. As the process is carried out and successive batches of parts are cleaned using the same cleaning solution, foreign substances, such as grease and oil and particulate matter, become suspended in the solution. After a certain amount of this material is contained in the cleaning solution, the solution becomes less effective for subsequently cleaning parts. The device described herein may be operated for a period of time until the solution contains more than the threshold allowable amount of foreign matter. This will generally be measured in terms of the passage of time or the number of times the machine has been started, but it can also be based on a measurement of the cleaning solution to determine how much foreign matter is actually present in the solution. When the predetermined amount of time, number of starts or foreign matter level has been exceeded, the cleaning device can no longer be started and must be serviced prior to its next use. In this servicing process, the cleaning solution, for example, is filtered to remove the foreign matter and additional components, such as rust inhibitors or biocides, may also be added to freshen the solution. The cleaning solution may also be replaced, but filtration is more efficient. The control device is then reset to allow the cleaning device to be operated again until the next time the solution becomes unusable. Thus, when this device is utilized, the items to be cleaned are placed in the vessel in the presence of an aqueous solution comprising from about 0.02% to about 5%, preferably from about 0.02% to about 1%, of the cleaning composition defined herein and ultrasonic energy is imparted to the contents of the vessel. After the cleaning device has been run for a predetermined length of time, has been started a predetermined number of times, or the foreign material in the solution has reached a predetermined level, the control device prevents the cleaner from being turned on. At that point, the machine is serviced by filtering (or replacing) the detergent solution to remove the foreign matter and the control means is reset to permit the use of the cleaning device for another predetermined amount of time or number of starts.

The following examples are intended to illustrate the compositions and methods of the present invention and are not intended to be limiting thereof.

EXAMPLE 1

A cleaning composition of the present invention is made having the components set forth below:

| Component | Weight % |
|---|---|
| Ethoxylated alcohol[1] | 65 |
| Fluorosurfactant[2] | 5 |
| Sodium acid pyrophosphate | 14 |
| Potassium tripolyphosphate | 10 |
| SAG 30 antifoam agent | 5 |
| Moisture and minor components | to100 |

[1]Neodol 1-5
[2]Zonyl 9027

The composition is made by mixing the components together, at room temperature, in the order listed above.

In an alternate method, the sodium acid pyrophosphate and potassium tripolyphosphate are dissolved in water, at 120–130° F., and the remaining materials are then added with mixing.

When soiled fabrics, particularly those containing greasy or oily soils, are agitated in an aqueous solution containing about 0.5% of this cleaning composition, the fabrics are cleaned. This process takes place at room temperature and at a neutral pH.

EXAMPLE 2

A composition for use in the cleaning of metal parts, having the components set forth below, is formulated in the following manner:

| Component | Weight % |
|---|---|
| Ethoxylated alcohol[1] | 65 |
| Fluorosurfactant[2] | 5 |

-continued

| Component | Weight % |
|---|---|
| Sodium acid pyrophosphate | 14 |
| Potassium tripolyphosphate | 10 |
| Moisture and minor components | To100 |

[1]Neodol 1-7
[2]Zonyl 9027

The composition is formulated as described in Example 1. Metal parts are cleaned using this composition by placing them in a vessel containing an aqueous solution containing about 1% of the detergent composition defined above. Ultrasonic energy, at a frequency of about 40,000 mHz, is imparted to the solution for a period of about 5–20 minutes. The parts are removed from the solution and are clean.

Alternatively, metal parts or plastic parts are cleaned using this composition in a spray wash apparatus. The spray wash apparatus may be operated at either low- or high-pressure wash conditions with a temperature range of 75° F.–180° F. for 5–20 minutes.

EXAMPLE 3

A cleaning composition of the present invention is made having the components set forth below:

| Component | Weight % |
|---|---|
| Ethoxylated alcohol[1] | 65 |
| Fluorosurfactant[2] | 5 |
| Sodium acid pyrophosphate | 14 |
| Potassium tripolyphosphate | 10 |
| Anti-corrosive agent[3] | 1 |
| Moisture and minor components | to100 |

[1]Neodol 1-5
[2]Zonyl 9027
[3]Zelec DI

The composition is made by mixing the components together, at room temperature, in the order listed above, with the addition of the anti-corrosive agent last. This process takes place at room temperature and at a neutral pH.

Metal parts are cleaned using this composition by placing them in a vessel containing an aqueous solution containing about 5% of the cleaning composition defined above. Ultrasonic energy, at a frequency of about 40,000 mHz, is imparted to the solution for a period of about 5–20 minutes. The parts are removed from the solution and are cleaned.

EXAMPLE 4

The composition described in Example 3 is used in a device for the cleaning of metal parts. The device includes a vessel (approximately 30 gallons) for holding the parts and a solution of the cleaning composition, a generator for providing ultrasonic energy to the contents of the vessel, and a control means. The cleaning composition is formulated as a 0.5% aqueous solution and 1.5 gallons of the solution are placed in the vessel. The control means is set such that the cleaning device cannot be restarted after it has run for 1,080 hours. Once that time has been exceeded, the cleaning device can no longer be started. At that point, the device is serviced to filter soil out of the solution, add rust inhibitor and biocide to the solution, and the control means is reset for 1,080 hours. The device can then continue to be used to clean metal parts.

What is claimed is:

1. A cleaning composition in the form of a homogeneous solution having a pH of about 6 to about 7.5, comprising:

(a) from about 45% to about 85% by weight of a $C_4$–$C_{15}$ alcohol ethoxylate containing from about 4 to about 10 ethoxy groups, or a mixture of such ethoxylates;

(b) from about 0.5% to about 10% by weight of fluorosurfactants selected from the group consisting of:

(I)

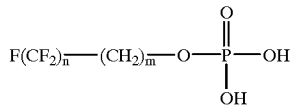

(II)

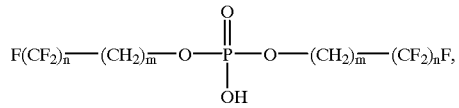

salts of those surfactants, and mixtures thereof, wherein each n is from about 6 to about 16 and each m is from about 1 to about 6; and (c) from about 5% to about 50% by weight of a detergent builder.

2. A cleaning composition according to claim 1 wherein the alcohol ethoxylate is a linear alcohol ethoxylate and has the formula:

$$(C_xH_{2x+1})O(CH_2CH_2O)_yH \quad \text{(III)}$$

wherein x is from about 5 to about 20 and y is from about 1 to about 15.

3. A cleaning composition according to claim 2 wherein in the alcohol ethoxylate component, x is from about 9 to about 15 and y is from about 5 to about 9.

4. A cleaning composition according to claim 3 wherein the detergent builder is a phosphate compound.

5. A cleaning composition according to claim 4 wherein the detergent builder is selected from the group consisting of SAPP, TKPP, and mixtures thereof.

6. A cleaning composition according to claim 3 wherein the fluorosurfactant is a mixture of compound (I) and compound (II) having a ratio of (I):(II) of from about 60:40 to about 50:50, and further wherein m=2.

7. A cleaning composition according to claim 5 wherein the fluorosurfactant is a mixture of compound (I) and (II) having a ratio of (I):(II) of from about 60:40 to about 50:50, and further wherein m=2.

8. A cleaning composition according to claim 7 wherein, in the alcohol ethoxylate component, x is from about 10 to about 11, and y is from about 5 to about 7.

9. A cleaning composition according to claim 8 which comprises from about 60% to about 70% by weight of the alcohol ethoxylate component, from about 1% to about 2.5%, by weight, of the fluorosurfactant, and from about 8% to about 30% by weight of the detergent builder component.

10. A cleaning composition according to claim 9 which additionally includes a solvent selected from the group consisting of lower alcohols, water, and mixtures thereof.

11. A cleaning composition according to claim 10 which additionally comprises from about 0.25% to about 1% by weight of diethanolamine.

12. A cleaning composition according to claim 4 which additionally comprises from about 0.5% to about 7% by weight of a defoaming agent.

13. A cleaning composition according to claim 12 wherein the defoaming agent is an aliphatic polyoxyethylene ether.

14. A cleaning composition according to claim 12 wherein the defoaming agent is an acetylenic diol.

15. A cleaning composition according to claim 4 which additionally comprises from about 0.5% to about 15% by weight of an anti-corrosive agent.

16. A cleaning composition according to claim 15 wherein the anti-corrosive agent comprises:

(a) a surfactant other than an alkyl acid phosphate;

(b) at least one alkyl acid phosphate, in a surfactant-phosphate weight ratio in the range between 10:1 and 1:10, said phosphate having the general formula:

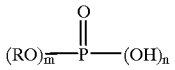

wherein R is an alkyl group having 4 to 20 carbon atoms;

m is 1 or 2; and n is 3-m.

17. A cleaning composition according to claim 16 wherein said phosphate is amine-neutralized with a tertiary amine.

18. A cleaning composition according to claim 17 wherein the anti-corrosive agent also contains from about 5% to about 40% by weight, based on the combined weight of said surfactant and said phosphate, of at least one carboxylic acid which has both a hydrophilic and hydrophobic portion.

19. A cleaning composition according to claim 15 wherein the anti-corrosive agent comprises:

(a) from about 70% to about 80% by weight a nitrogen and sulfur-containing aryl heterocycle; and (b) from about 20% to about 30%, by weight, of an alkanolamine.

20. A cleaning composition according to claim 19 wherein the alkanolamine is triethanolamine.

21. A cleaning composition according to claim 20 wherein the aryl heterocycle is 10-H-phenothiazine.

22. A method for cleaning fabrics comprising the agitation of said fabrics in an aqueous solution comprising from about 0.25% to about 5% by weight of the cleaning composition of claim 1.

23. A method for cleaning hard surfaces comprising contacting said surfaces with an aqueous solution comprising from about 0.02% to about 5% by weight of the cleaning composition of claim 1.

24. A method for cleaning hard surfaces comprising contacting said surfaces with an aqueous solution comprising from about 0.02% to about 5% by weight of the cleaning composition of claim 10, wherein the hard surfaces being cleaned comprise metal and plastic surfaces.

25. A method for cleaning hard surfaces comprising contacting said surfaces with an aqueous solution comprising from about 0.02% to about 5% by weight of the cleaning composition of claim 15, wherein the hard surfaces being cleaned comprise metal and plastic surfaces.

26. A method for cleaning hard surfaces according to claim 24 wherein a pressurized aqueous solution contacts the surface being cleaned.

27. A method for cleaning hard surfaces according to claim 25 wherein a pressurized aqueous solution contacts the surface being cleaned.

* * * * *

UNITED STATES PATENT AND TRADEMARK OFFICE

CERTIFICATE OF CORRECTION

PATENT NO. : 6,258,772 B1
DATED : July 10, 2001
INVENTOR(S) : Robert C. Yeggy & Vito J. Alta Villa It is certified that error appears in the above-identified patent and that said Letters Patent is hereby corrected as shown below:

Title page,
Item [57] ABSTRACT,
Line 9, "oilly" should read -- oily --

Column 4,
Line 23, please delete "and"

Column 5,
Line 48, "(SAPP), tripotassium" should read -- (SAPP). Tripotassium --

Column 6,
Line 23, "which is mix" should read -- which is a mix --

Column 7,
Line 6, "($C_{1-C4}$)" should read -- ($C_1$-$C_4$) --

Column 9,
(Table), last entry under "Weight %" should read -- to 100 --

Signed and Sealed this

Fifth Day of March, 2002

*Attest:*

*Attesting Officer*

JAMES E. ROGAN
*Director of the United States Patent and Trademark Office*